United States Patent [19]

Schiabel

[11] 4,145,162

[45] Mar. 20, 1979

[54] GETTER DEVICE AND METHOD OF USE

[75] Inventor: Antonio Schiabel, Milan, Italy

[73] Assignee: S.A.E.S. Getters S.p.A., Milan, Italy

[21] Appl. No.: 855,950

[22] Filed: Nov. 30, 1977

[30] Foreign Application Priority Data

Dec. 6, 1976 [IT] Italy ..... 30156 A/76

[51] Int. Cl.[2] ..... F04B 37/02

[52] U.S. Cl. ..... 417/48; 313/181; 313/481

[58] Field of Search ..... 417/48, 51; 313/481, 313/178, 180, 181

[56] References Cited

U.S. PATENT DOCUMENTS

| | | | |
|---|---|---|---|
| 2,907,451 | 10/1959 | Porta | 417/48 |
| 3,719,433 | 3/1973 | Rabusin | 417/48 |
| 3,996,488 | 12/1976 | Zucchinelli | 313/181 X |
| 4,029,987 | 6/1977 | Zucchinelli | 313/481 X |

FOREIGN PATENT DOCUMENTS

| | | | |
|---|---|---|---|
| 2303749 | 10/1973 | Fed. Rep. of Germany | 313/481 |

*Primary Examiner*—Carlton R. Croyle
*Assistant Examiner*—Edward Look
*Attorney, Agent, or Firm*—Littlepage, Quaintance, Murphy, Richardson and Webner

[57] ABSTRACT

A getter device comprising a U-shaped ring, a base disc, and an annular disc.

2 Claims, 3 Drawing Figures

GETTER DEVICE AND METHOD OF USE

FIELD OF THE INVENTION

The present invention relates to getter devices mainly intended for use in colour television kinescopes known variously as "post focusing" or "post deflection focusing" or "mask focusing" tubes in which the post focusing electrode is particularly susceptible to deformation due to pick up of the high frequency electro-magnetic radiation used to evaporate getter metal vapors from a getter device located close to the post focusing electrode.

BACKGROUND OF THE INVENTION

The use of getter devices in electronic tubes is well known. A commonly used getter construction consists of a metal holder supporting a material capable of realising a getter metal vapor upon heating. A particular type of electronic tube which requires the use of a getter device is a television picture tube which generally comprises a neck portion which houses an electron gun structure and an enlarged cone portion which terminates in a generally flat viewing screen covered internally with a phosphor layer. A cone portion joins the neck and screen portions. Colour television picture tubes are in addition provided with a shadow mask or a colour selection electrode disposed in spaced relation to the screen but in close proximity thereto. The shadow mask or colour selection electrode is generally supported by a metal frame. The frame may also support a shield or correction electrode confronting the inner surface of the cone portion.

Various types of colour television picture tubes known for example as the post focusing or post deflection focusing tube as well as other types such as the Chromatron type tube can employ a post focusing shield or correction electrode. Such a shield electrode aids in focusing the electron beam into a high density beam which upon impingement on the phosphor layer causes a brighter and sharper image with improved colour purity. The three-dimensional shape of the shield electrode is very critical to the good functioning of the colour television picture tube as one of its main functions is to act as electrostatic lens in guiding electrons onto desired positions on the fluorescent viewing screen.

It has been found convenient to place the getter device on, or close to, the shadow mask or shield electrode as described for instance in U.S. Pat. No. 3,792,300 or United Kingdom Pat. No. 1,226,728. However prior art getter devices located in these positions have proved to have one or more defects. In order to cause getter metal to be evaporated from the getter device an electro-magnetic induction heating coil is placed outside the picture tube in the vicinity of the getter device. The getter device is, of course, within the picture tube which at this stage is usually partially evacuated and sealed. On passing a high frequency alternating current through the induction heating coil, electric currents are induced within the getter device which consequently heats up until getter metal evaporates. When the getter device is located close to the shield electrode it is found that this electrode also picks up energy from the induction heating coil. Localized non-uniform heating of the shield electrode takes place. This non-uniform heating results in stresses being induced in the shield electrode resulting in a permanent mechanical deformation of its shape. When the shield electrode then functions as an electrostatic lens the electrons are not properly guided onto their desired position thus resulting in a degradation of picture quality. Furthermore excessive heating of the shield electrode can lead to the production of unwanted harmful gases.

Although Japanese Application Publication No. 47-40669 describes a method of heating a getter device by radiant heat, thus obviating the inconvenience of induction heating, this alternative is not possible within a television picture tube for several reasons. First the internal surfaces of the tube are usually coated with a layer of graphite or other conductive material which acts as an opague barrier to the transmission of radiant heat. Second even if a small window is made in the opaque barrier the thickness of the glass required for the construction of the television picture tube to support the internal vacuum is so large that most of the radiant heat is sorbed by the glass rather than being transmitted through it.

It is therefore an object of the present invention to provide a getter device free from one or more defects of the prior art getter devices.

It is another object of the present invention to provide a getter device for use in post deflection focusing picture tubes which does not cause distortion of the shield electrode upon the evaporation of the getter metal.

Yet another object of the present invention is to provide a getter device which does not cause excessive gas release from the shield electrode upon evaporating getter metal.

Further objects and advantages of the present invention will become apparent by reference to the following description thereof and drawings wherein.

The present invention therefore provides a U shaped ring channel getter device comprising a first element comprising an inner wall, an outer wall, and a bottom wall joining the inner wall to the outer wall. The inner wall comprises a first wall portion substantially parallel to and of substantially the same height as the outer wall and a second wall portion extending upwardly and outwardly to a distance not exceeding the radius of the outer wall. The getter device further comprises an evaporable getter metal vapor releasing material supported by the first element. The getter device also comprises a second element comprising a base disc substantially parallel to the bottom wall of the first element and a cylindrical portion attached at one end to the outer periphery of the base disc and in thermal contact with the first portion of said inner wall and the other end of the cylindrical portion supporting an annular disc outwardly extending to a distance substantially equal to the radius of the outer wall. The annular disc is also in at least line contact with said second portion of said inner wall.

Japanese Patent Application Publication No. 1130/1970, published Jan. 14, 1970 describes a getter metal container in the form of an annular trough in which the inner wall also comprises a second wall portion extending upwardly and outwardly to a distance not exceeding the radius of the outer wall. However this getter device is not capable of shielding a correction electrode from high frequency electro-magnetic radiation. See also Japanese Utility Model Application Publication No. 19301/1965, published July 6, 1965.

Japanese Utility Model Application Publication No. 2565/1964, published Feb. 1, 1964, shows a getter device which is capable of evaporating getter metal vapors in a substantially radial direction. However this getter device is still not capable of shielding a correction electrode from high frequency electro-magnetic radiation.

U.S. Pat. No. 3,033,354 patented May 8, 1962, shows a getter device which comprises a disc portion attached to the inner wall of the getter device. However it is seen with this device that the direction of evaporation of getter metal vapors is substantially inwardly and furthermore the disc member is provided to protect the electrodes of an electronic tube from bombardment by falling getter vapor particles. There is no suggestion that the disc member can protect a correction electrode in a colour television kinescope from high frequency electro-magnetic radiation.

U.S. Pat. No. 3,719,433 shows a separate shield but fails to disclose a disc. Furthermore there is no disclosure of the use in combination of a shield, a disc and outwardly extending inner ring walls. Such a device is not capable of shielding a correction electrode from high frequency electro-magnetic radiation.

Figure 1:
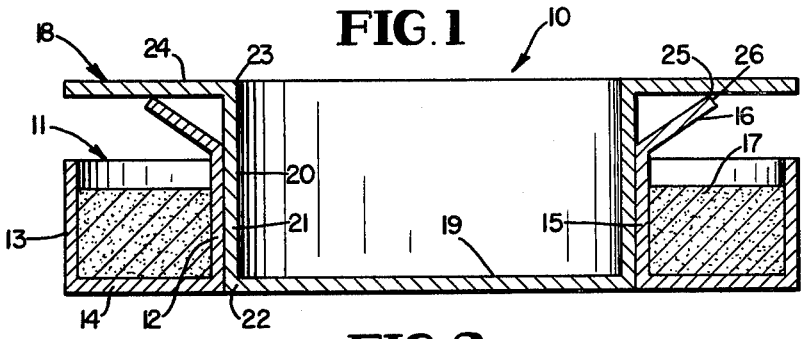
FIG. 1 is a cross sectional view of a getter device of the present invention.

Referring now to the drawings and in particular to FIG. 1 there is shown a getter device 10 of the present invention. Getter device 10 comprises a first element 11 comprising an inner wall 12 and outer wall 13 and a bottom wall 14 joining inner wall 12 to outer wall 13. Inner wall 12 comprises a first wall portion 15 substantially parallel to and of substantially the same height as outer wall 13. Inner wall 12 also comprises a second wall portion 16 extending upwardly and outwardly to a distance not exceeding the radius of the said outer wall 13.

An evaporable getter metal vapor releasing material 17 is supported by the first element 11. A second element 18 comprises a base disc 19 substantially parallel to bottom wall 14 of first element 11. A cylindrical portion 20 is attached at one end 21 to the outer periphery 22 of base disc 19. In this case cylindrical portion 20 is in thermal contact with substantially all of said first wall portion 15 of inner wall 12. The other end 23 of cylindrical portion 20 supports an annular disc 24 which extends outwardly to a distance substantially equal to the radius of outer wall 13. Annular disc 24 forms a line contact 25 with upper edge 26 of second wall portion 16.

Figure 2:
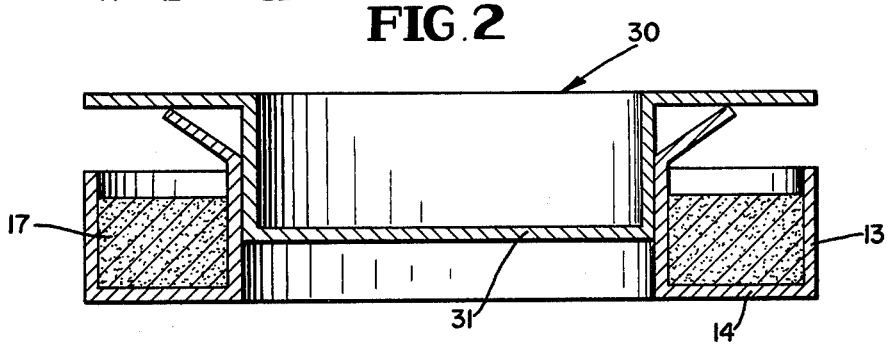
FIG. 2 is a cross sectional of a second getter device of the present invention.

FIG. 2 shows a second getter device 30 of the present invention which is similar in all respects to getter device 10 except that base disc 31 while still being substantially parallel to bottom wall 14 is distanced from the plane thereof.

In the broadest sense of the invention any getter metal vapor releasing material may be used. However a preferred getter metal vapor releasing material is an alloy of approximately 50 weight % barium with aluminum. Another preferred getter metal vapor releasing material is a mixture of the above mentioned barium-aluminum alloy with approximately 50% nickel.

The term "getter metal vapor releasing material" as used in the specification and claims herein is meant to include both the material prior to and after getter metal vapor release. This term embraces both the material in the form sold with the getter device and in the form in which it is found in an operating tube wherein the bulk of the getter metal has been evaporated from the material and is in the form of a film on the inside surface of the tube.

In order to cause getter metal vapours to be evaporated from the getter device an alternating current is induced within the device by means of high frequency induction coil. The induction coil is placed near the getter device and may preferably be furnished with a ferromagnetic concentrator to provide a more intense induction field within the vicinity of the getter device.

Figure 3:
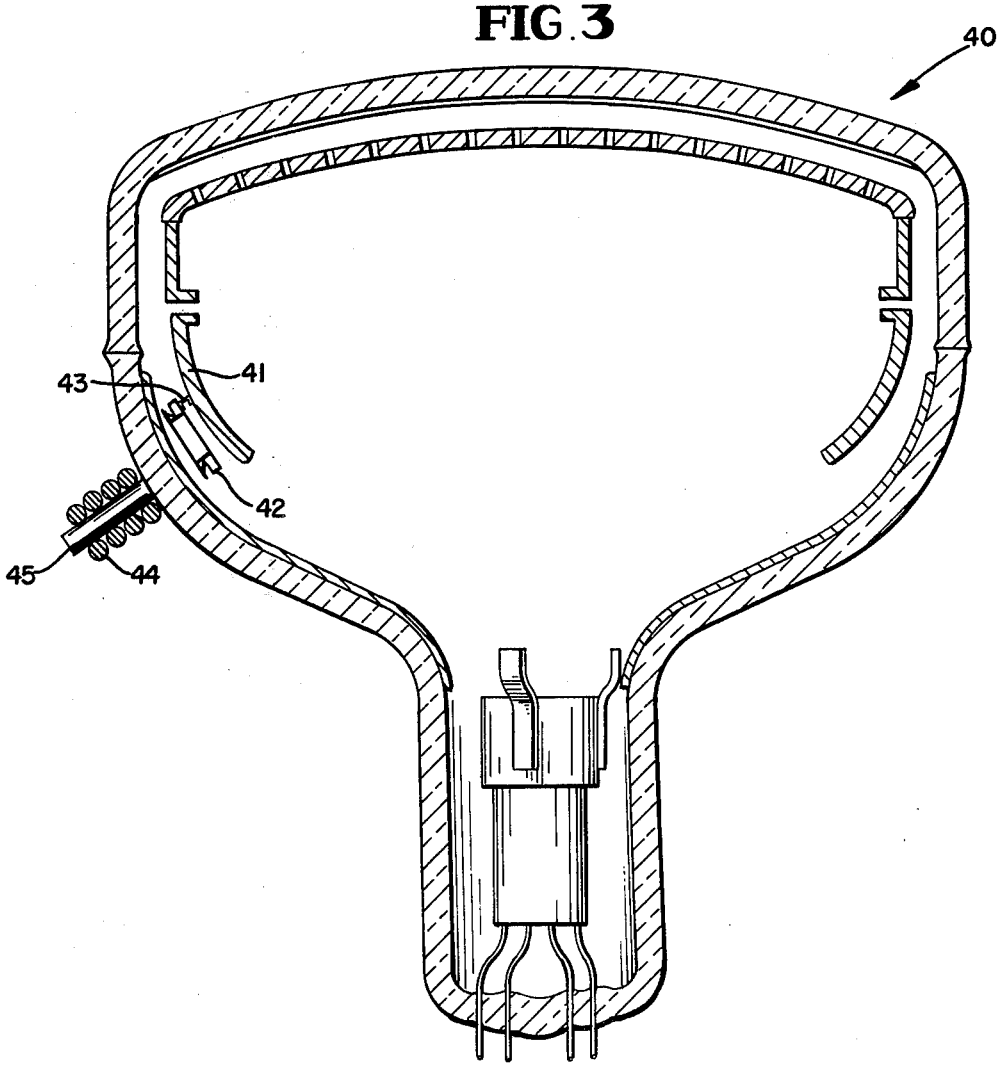
FIG. 3 is a cross section of a post focusing colour television picture tube employing a getter device of the present invention.

FIG. 3 shows a colour television kinescope 40 employing a correction electrode 41 and a getter device 10 of the present invention. Getter device 10 is attached by a support 43 to correction electrode 41. A high frequency induction coil 44 provided with a ferromagnetic concentrator 45 is placed outside kinescope 40 in a position approximately coincident with that of the getter device 10. Concentrator 45 is in the form of a solid cylinder placed coaxially within, and having approximately the same height as, induction coil 44. On allowing high frequency energy to power coil 44 it is found that getter device 42 heats up to a sufficient temperature to cause radial evaporation of barium without causing the correction electrode 41 to heat up to such a temperature that permanent deformation occurs.

Although the invention has been described in considerable detail with reference to certain preferred embodiments thereof, it will be understood the variations and modifications can be effected within the spirit and scope of the invention as described above and as defined in the appended claims.

What is claimed is:

1. A getter device comprising:

a. a first element in the form of a U shaped ring channel comprising an inner wall, an outer wall, and a bottom wall joining said inner wall to said outer wall, said inner wall comprising a first wall portion substantially parallel to and of substantially the same height as said outer wall and a second wall portion extending upwardly and outwardly to a distance not exceeding the radius of said outer wall and b. an evaporable getter metal vapour releasing material supported by said first element and c. a second element comprising a base disc substantially parallel to said bottom wall of said first element and a cylindrical portion attached at one end to the outer periphery of said base disc and in thermal contact with said first portion of said inner wall and the other end of said cylindrical portion supporting an annular disc outwardly extending to a distance substantially equal to the radius of said outer wall said annular disc also being in at least line contact with said second portion of said inner wall.

2. A getter device of claim 1 in which the evaporable getter metal is a Ba-Al alloy in mixture with nickel.

* * * * *